US007676857B1

(12) United States Patent
Zuidema

(10) Patent No.: US 7,676,857 B1
(45) Date of Patent: Mar. 16, 2010

(54) TOILET SEAT AND LID LIFTER ASSEMBLY

(76) Inventor: Shawn M. Zuidema, 21537 Carlton St., Crest Hill, IL (US) 60435

( * ) Notice: Subject to any disclaimer, the term of this patent is extended or adjusted under 35 U.S.C. 154(b) by 439 days.

(21) Appl. No.: 11/765,580

(22) Filed: Jun. 20, 2007

(51) Int. Cl.
*A47K 13/10* (2006.01)

(52) U.S. Cl. ..... 4/246.1; 4/234; 16/904

(58) Field of Classification Search ..... 4/246.1, 4/246.3, 246.4, 234, 236, 253; 292/256, 292/65; 248/426; 16/904, 905, 110.1; 294/15, 294/26

See application file for complete search history.

(56) References Cited

U.S. PATENT DOCUMENTS

| | | | | |
|---|---|---|---|---|
| 2,758,315 | A * | 8/1956 | Hylton | 4/246.1 |
| 3,431,004 | A * | 3/1969 | Schell | 292/258 |
| 5,027,472 | A * | 7/1991 | Goodman | 16/422 |
| 7,137,154 | B2 * | 11/2006 | Miller et al. | 4/234 |
| 7,552,485 | B1 * | 6/2009 | Harrison, Jr. | 4/246.1 |

* cited by examiner

*Primary Examiner*—Sam Chuan C Yao
*Assistant Examiner*—Janie Christiansen

(57) ABSTRACT

A toilet seat and lid lifter assembly which is constructed of a first frame member of generally U-shape and a second frame member of generally S-shape for gripping both a toilet seat and a toilet lid together such that the seat and lid can be simultaneously lifted or lowered without having to touch by hand.

6 Claims, 3 Drawing Sheets

TOILET SEAT AND LID LIFTER ASSEMBLY

FIELD OF THE INVENTION

The present invention generally relates to a toiletry accessory and more particularly, relates to a toilet seat/lid lifter that can be used to lift the toilet seat and the toilet lid simultaneously.

BACKGROUND OF THE INVENTION

In the use of a toilet, the toilet seat and the toilet lid have to be lifted frequently when the toilet is used for certain purposes. For instance, when the toilet is used for urination by a male. This becomes a tedious task since most people lift one thing at a time, i.e. lifting the toilet lid first and then lifting the toilet seat after the lid has been lifted. It is especially tedious when in a public bathroom since the lid and the seat are usually not clean and it becomes a dreadful job for lifting the seat and the lid. It is therefore desirable to provide a way of lifting the toilet seat and the toilet lid simultaneously without having to touch either the seat or the lid by a person's hand.

It is therefore an object of the present invention to provide a simple tool that can be used to lift a toilet seat and a toilet lid simultaneously without having to touch them by hand.

It is another object of the present invention to provide a simple tool for lifting a toilet seat and toilet lid simultaneously that is of a compact size and can be carried easily by the user.

SUMMARY OF THE INVENTION

In accordance with the present invention, a toilet seat/lid lifter assembly is provided.

The present invention toilet seat/lid lifter assembly is constructed of a first frame member of generally U-shape that has a first and a second parallel straight sections connected thereinbetween by a third straight section; a first distance between the first and the second parallel sections that is at least a total thickness of the toilet seat and the toilet lid; and a second frame member of generally S-shape that has a free end connecting to the second straight section of the first frame member in a spring-loaded manner such that a second distance between parallelly positioned center section of the S-shape frame member and the third straight section of the first frame member is at least a total width of the toilet seat.

BRIEF DESCRIPTION OF THE DRAWINGS

The invention will now be described, by way of example, with reference to the accompanying drawings, in which.

DETAILED DESCRIPTIONS OF THE PREFERRED EMBODIMENT

The present invention discloses a toilet seat/lid lifter assembly that can be easily used on a toilet to lift the toilet seat and the toilet lid simultaneously without having to touch them by the user's hand.

The present invention toilet seat/lid lifter assembly is a handle that eliminates the need to touch a toilet seat and lid with the hands while lifting them. The handle can make it easier to lift and lower the seat and lid. The present invention lifter assembly can be produced from either a natural material such as wood or from plastic. The lifter assembly measures about between 1 and 2 inches long and between 6 and 8 inches high. It is designed with a spring-loaded clamp that would grip both the seat and lid and hold them together. The grip itself has an ergonomic design to make it easy to hold. To use the lifter assembly, the user can simply grip the handle and use it to lift the seat and lid together. The present invention toilet seat/lid lifter assembly is particularly suitable for use by those person's who have to use public bathrooms. It enables a person to easily lift and lower that toilet seat and lid without touching them. It also increases sanitation when using the bathroom by eliminating the need to touch the toilet seat. The handle reduces strain by making it easier to lift the seat and lid together, and it helps to remind male members of the household to lift the seat and lid before use and lower them after use.

The present invention toilet seat/lid lifter assembly fulfills the need for greater sanitation when lifting and lowering a toilet seat and lid, as well as providing ease in performing this function. In addition, its presence would remind a person to lift the seat and lid before use and lower them after use. The convenience of using the lifter assembly further encourages its use.

The appealing features of the present invention toilet seat/lid lifter assembly are its elimination of the need to touch the toilet seat and lid with the user's hands, its practicality, and its functionality. It can also be easily installed and cleaned. The seat lifter assembly is durable and does not rust. The accessory can also be decorative and reasonably priced. It offers the consumer convenience, especially in a public restroom, by eliminating the need to use the foot or toilet tissue to lift an unsanitary seat and lid. It can be made in a variety of colors to add decoration to the bathroom.

Figure 1:
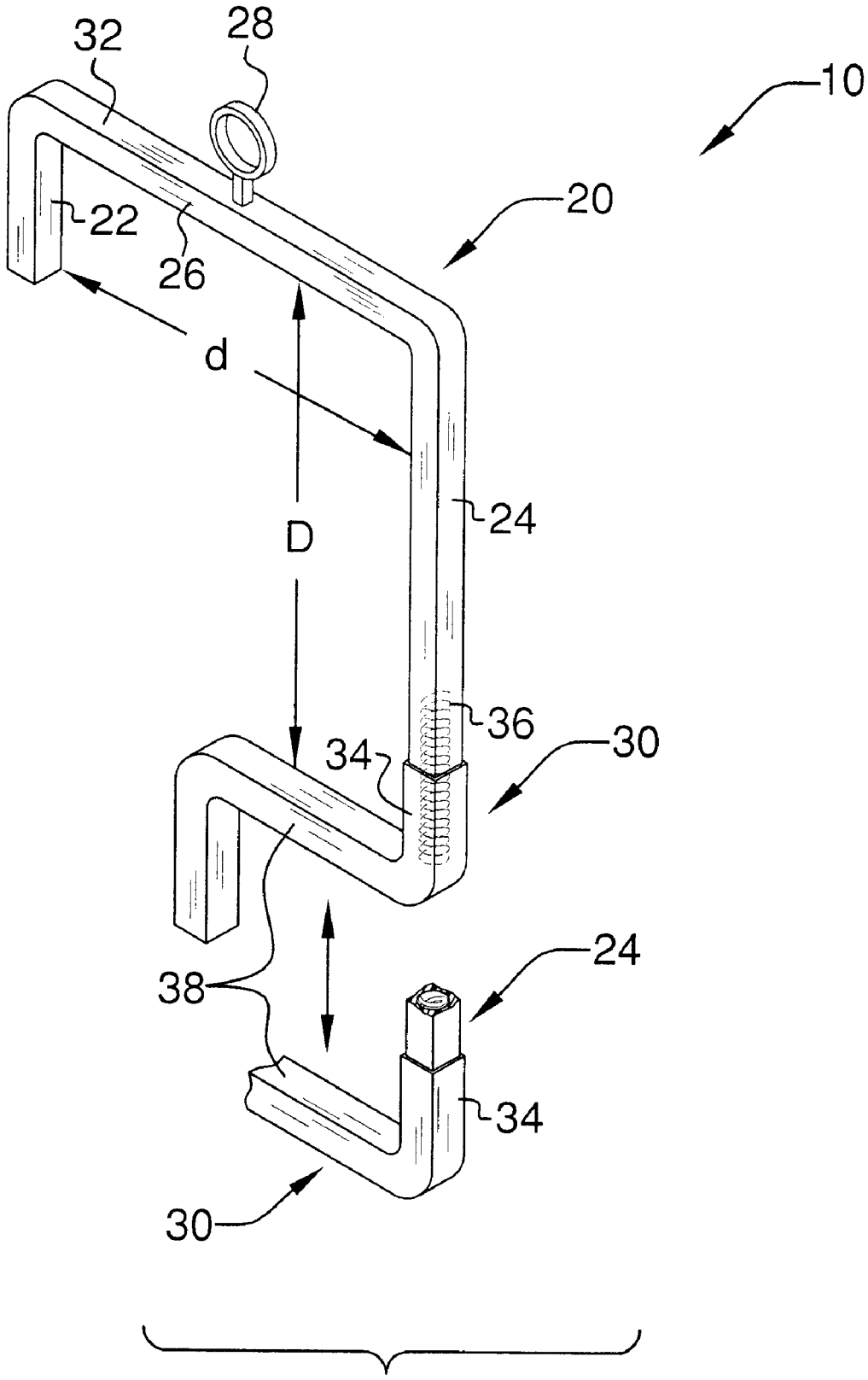
FIG. 1 is a perspective view of the present invention toilet seat/lid lifter assembly.

Referring initially to FIG. 1, wherein a perspective view of the present invention toilet seat/lid lifter assembly 10 is shown. The lifter assembly 10 is constructed of a first frame member 20 of generally U-shape which has a first straight section 22, a second straight section 24 which is parallel to first straight section 22. The first straight section 22 and the second straight section 24 are connected thereinbetween by a third straight section 26. A finger loop 28 is mounted on the outside surface 32 of the third straight section 26 for easy grip by a users finger.

Figure 2:
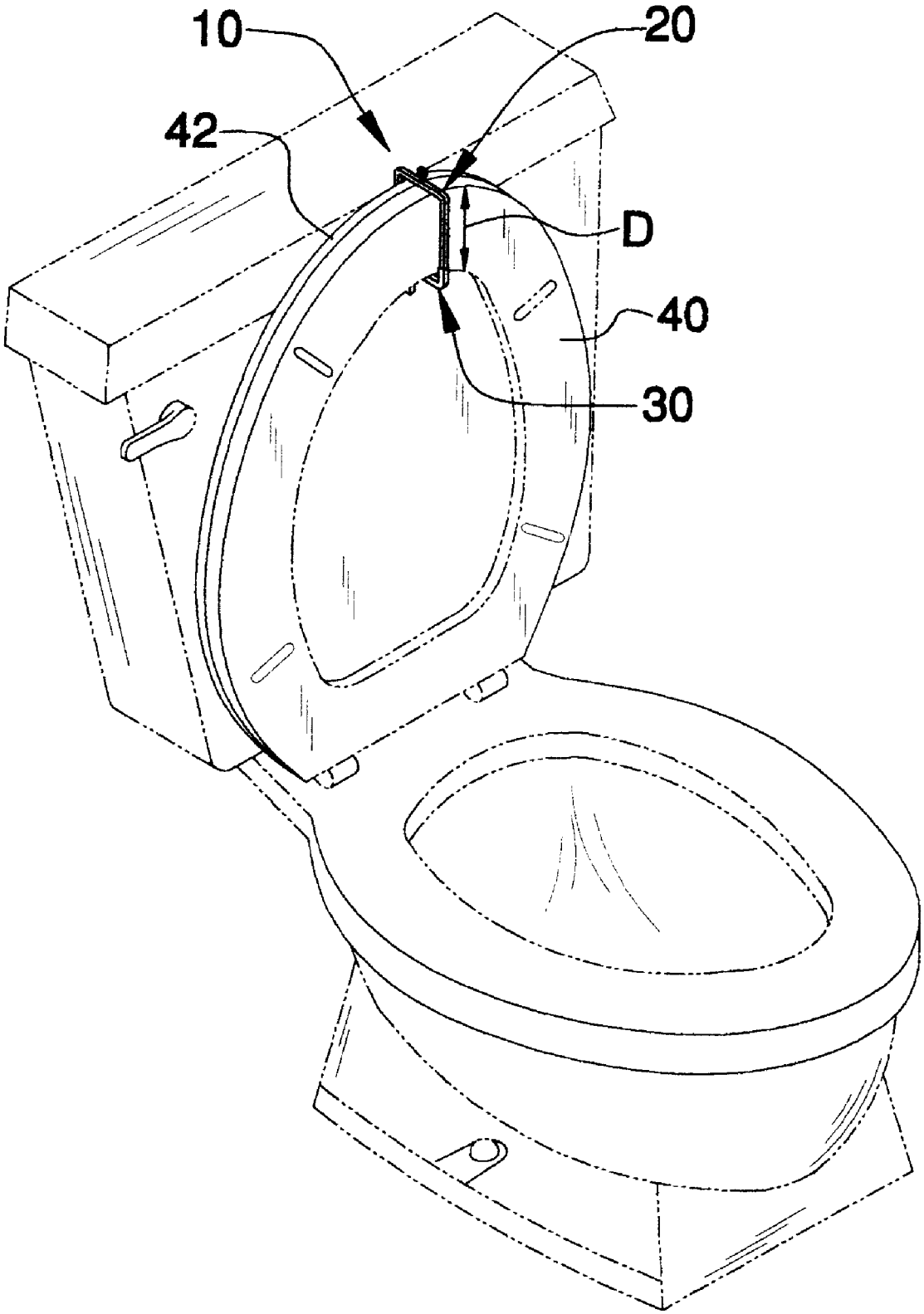
FIG. 2 is a perspective view of a toilet with the present invention toilet seat/lid lifter assembly installed thereon.

A first distance "d" between the first and the second parallel straight section 22, 24 is at least a total thickness of the toilet seat 40 and the toilet lid 42 (shown in FIG. 2).

A second frame member 30 of generally S-shape which has free end 34 connecting to the second straight section 24 of the first frame member 20 in a spring-loaded manner by spring 36 such that a second distance "D" between parallelly positioned center section 38 of the S-shaped frame member 30 and the third straight section 26 of the first frame member 20 is at least a total width of the toilet seat 40 and the toilet lid 42, as shown in FIGS. 1 and 2.

Figure 3:
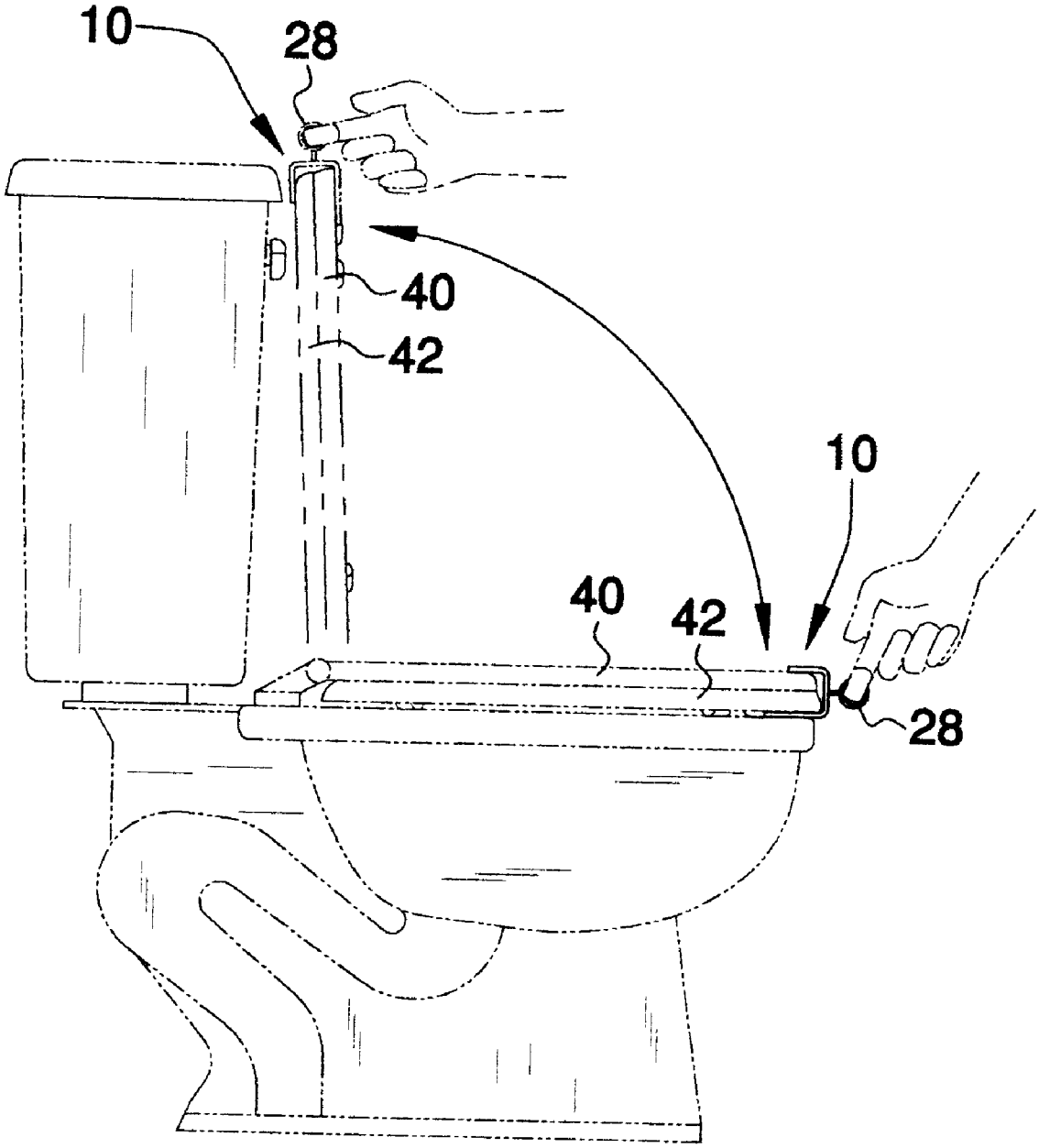
FIG. 3 is a side view of the toilet of FIG. 2 illustrating the use of the present invention toilet seat/lid lifter assembly.

The use of the present invention toilet seat/lid lifter assembly is illustrated in FIG. 3 in a side view. It is seen that the finger loop 28 is used to easily grip both the toilet seat 40 and the toilet lid 42 in either a lifting motion or in a lowering motion.

The present invention toilet seat/lid lifter assembly has therefore been amply described in the above descriptions and in the appended drawings of FIGS. 1-3.

While the preferred embodiments of the invention have been described above, it will be recognized and understood that various modifications can be made in the invention and the appended claims are intended to cover all such modifications which may fall within the spirit and scope of the invention.

The invention claimed is:

1. A toilet seat and lid lifter assembly comprising:

a first frame member of generally U-shape having a first and a second parallel straight sections connected thereinbetween by a third straight section;

a finger loop mounted on an outside surface of said third straight section;

a first distance between said first and said second parallel straight sections that is at least a total thickness of said toilet seat and the toilet lid;

a second frame member of generally S-shape having a free end connecting to said second straight section of said first frame member in a spring-loaded manner such that a second distance between parallelly positioned center section of the S-shape frame member and said third straight section of the first frame member is at least a total width of said toilet seat.

2. The toilet seat and lid lifter assembly according to claim 1, wherein said first frame member and said second frame member are fabricated of wood.

3. The toilet seat and lid lifter assembly according to claim 1, wherein said first frame member and said second frame member are fabricated in plastic.

4. The toilet seat and lid lifter assembly according to claim 1, wherein said finger loop is fabricated in metal.

5. The toilet seat and lid lifter assembly according to claim 1, wherein said finger loop is molded of plastic in a process together with the first frame member.

6. The toilet seat and lid lifter assembly according to claim 1, further comprising a spring member pulling the first frame member and the second frame member toward each other thereby providing a spring-loaded gripping on the toilet seat and lid.

* * * * *